US006829199B2

(12) United States Patent
Shimizu et al.

(10) Patent No.: US 6,829,199 B2
(45) Date of Patent: Dec. 7, 2004

(54) ELECTRONIC APPARATUS, ELECTRONICALLY CONTROLLED MECHANICAL TIMEPIECE, METHODS OF CONTROLLING THEM, PROGRAM FOR CONTROLLING ELECTRONIC APPARATUS, AND STORAGE MEDIUM

(75) Inventors: Eisaku Shimizu, Okaya (JP); Kunio Koike, Matsumoto (JP); Hidenori Nakamura, Shimosuwa-machi (JP)

(73) Assignee: Seiko Epson Corporation, Tokyo (JP)

( * ) Notice: Subject to any disclaimer, the term of this patent is extended or adjusted under 35 U.S.C. 154(b) by 261 days.

(21) Appl. No.: 10/087,646

(22) Filed: Mar. 1, 2002

(65) Prior Publication Data

US 2004/0013047 A1 Jan. 22, 2004

(51) Int. Cl.[7] ..... G04B 1/00; G04C 3/00; G04F 5/00

(52) U.S. Cl. ..... 368/64; 368/157; 368/204

(58) Field of Search ..... 368/64, 155–157, 368/203, 204

(56) References Cited

U.S. PATENT DOCUMENTS 5,699,322 A 12/1997 Born
5,740,131 A * 4/1998 Bernasconi ..... 368/148
5,751,666 A * 5/1998 Farine et al. ..... 368/140
6,314,059 B1 * 11/2001 Shimizu et al. ..... 368/157

FOREIGN PATENT DOCUMENTS

| | | |
|---|---|---|
| EP | 0 905 589 A2 | 3/1999 |
| JP | 9-54173 | 2/1997 |
| JP | 2000-28757 | 1/2000 |
| JP | 2001-51070 | 2/2001 |

* cited by examiner

*Primary Examiner*—Vit W. Miska
(74) *Attorney, Agent, or Firm*—Rosalio Haro

(57) ABSTRACT

An electronically controlled mechanical timepiece, which is an electronic apparatus, includes a generator driven by a mainspring to generate electrical energy, and a rotation controlling unit driven by the electrical energy to control the rotation rate of the generator. The rotation controlling unit includes a brake controlling unit that compares a rotation detection signal indicative of the rotation rate of the generator with a reference signal to control braking on the generator, and a generator halting unit that applies a brake and halts the generator if the braking amount applied to the generator in a predetermined time is smaller than, or equal to, a first predetermined braking value. Because the generator is halted if a predetermined amount of cumulative brake applications are applied within the predetermined time, the generator is not halted in response to temporary disturbances while it is assuredly halted when the rotation becomes slow.

13 Claims, 10 Drawing Sheets

〔FIG. 1〕
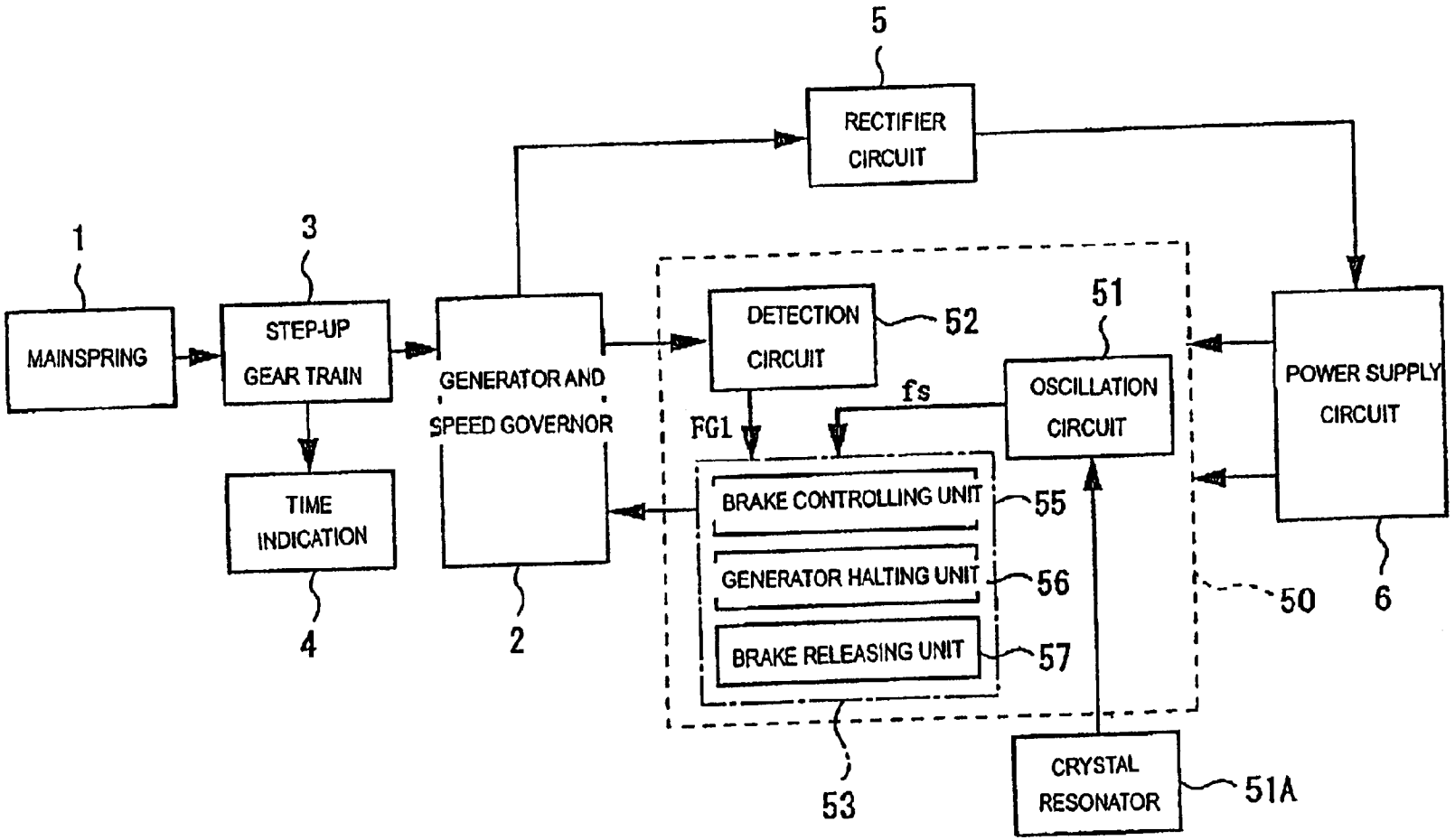

〔FIG. 2〕
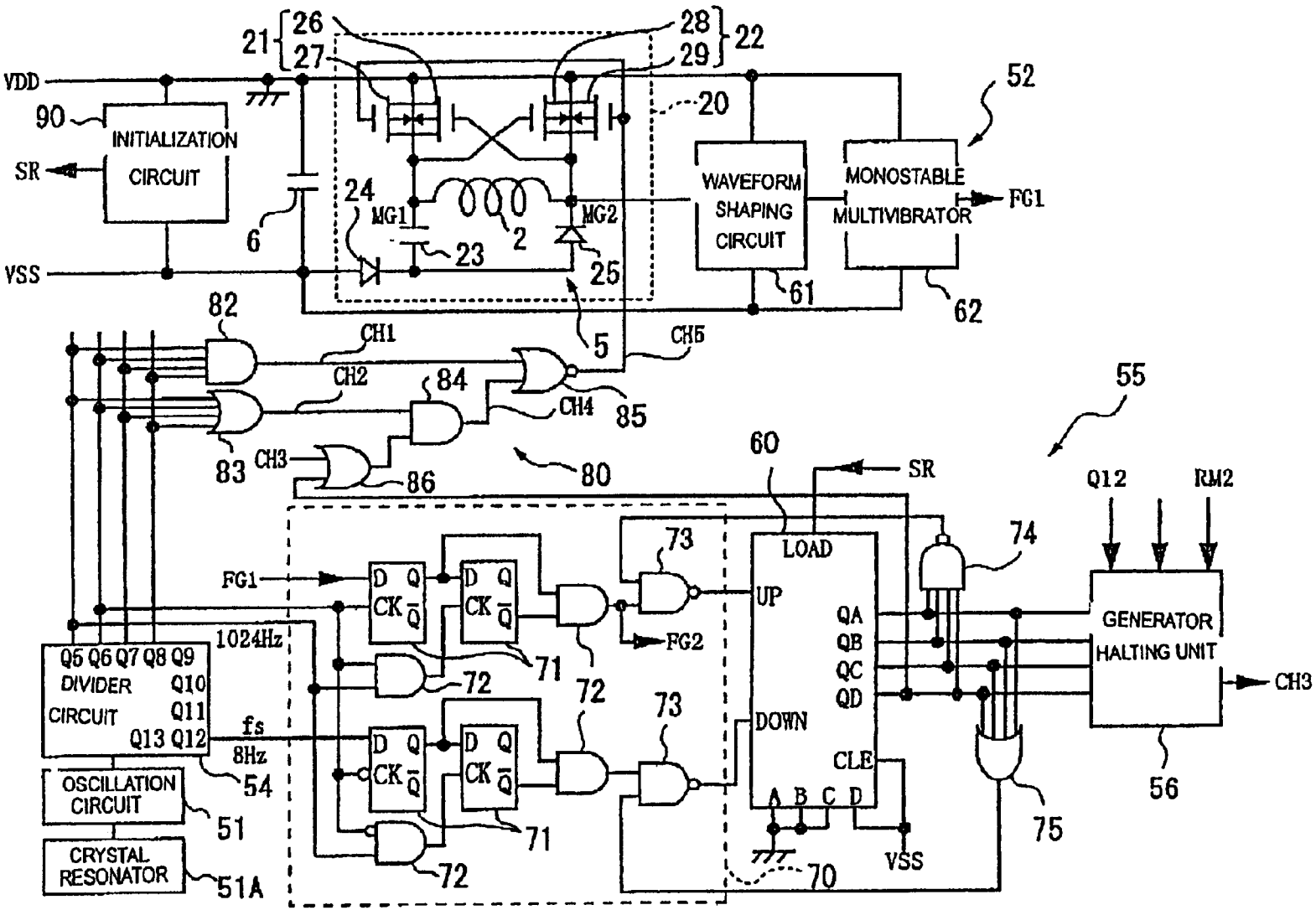

〔FIG. 3〕
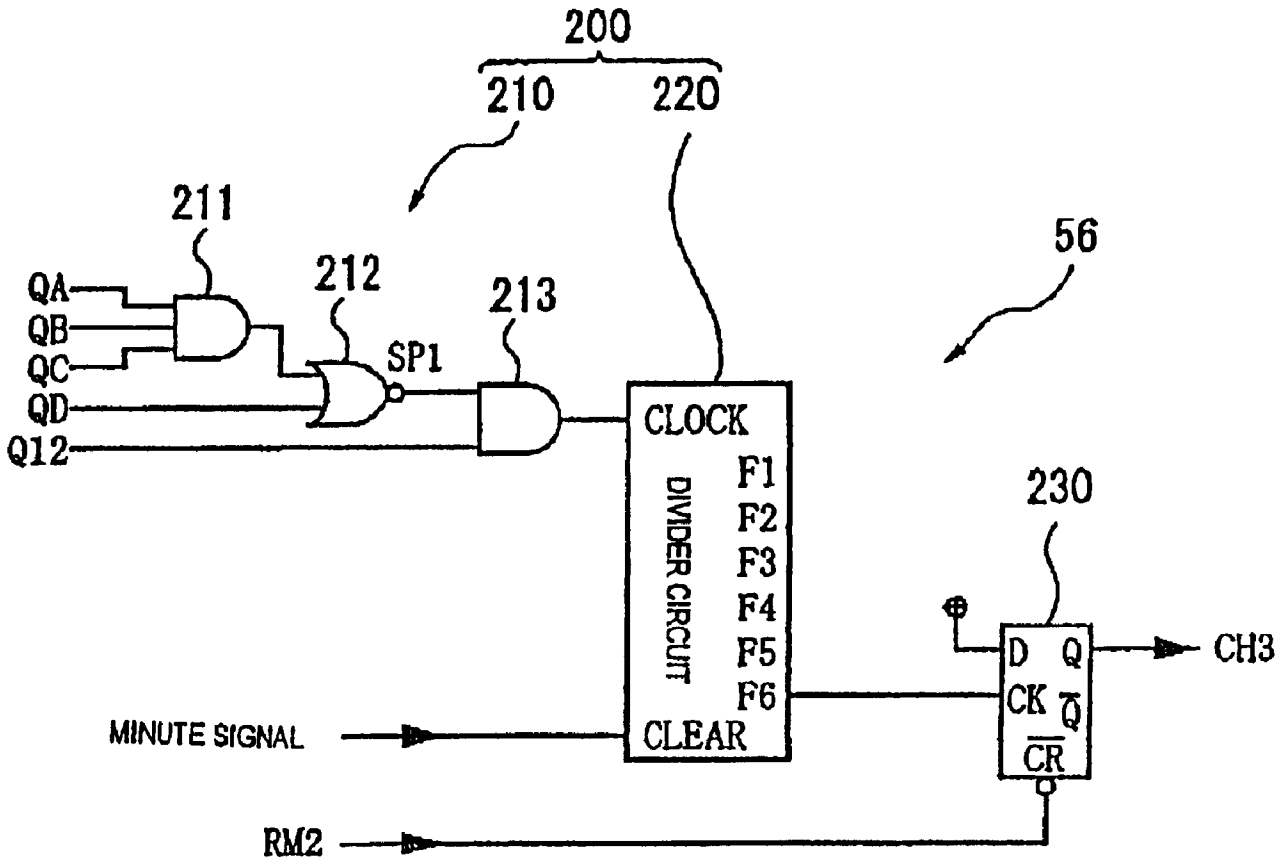

〔FIG. 4〕
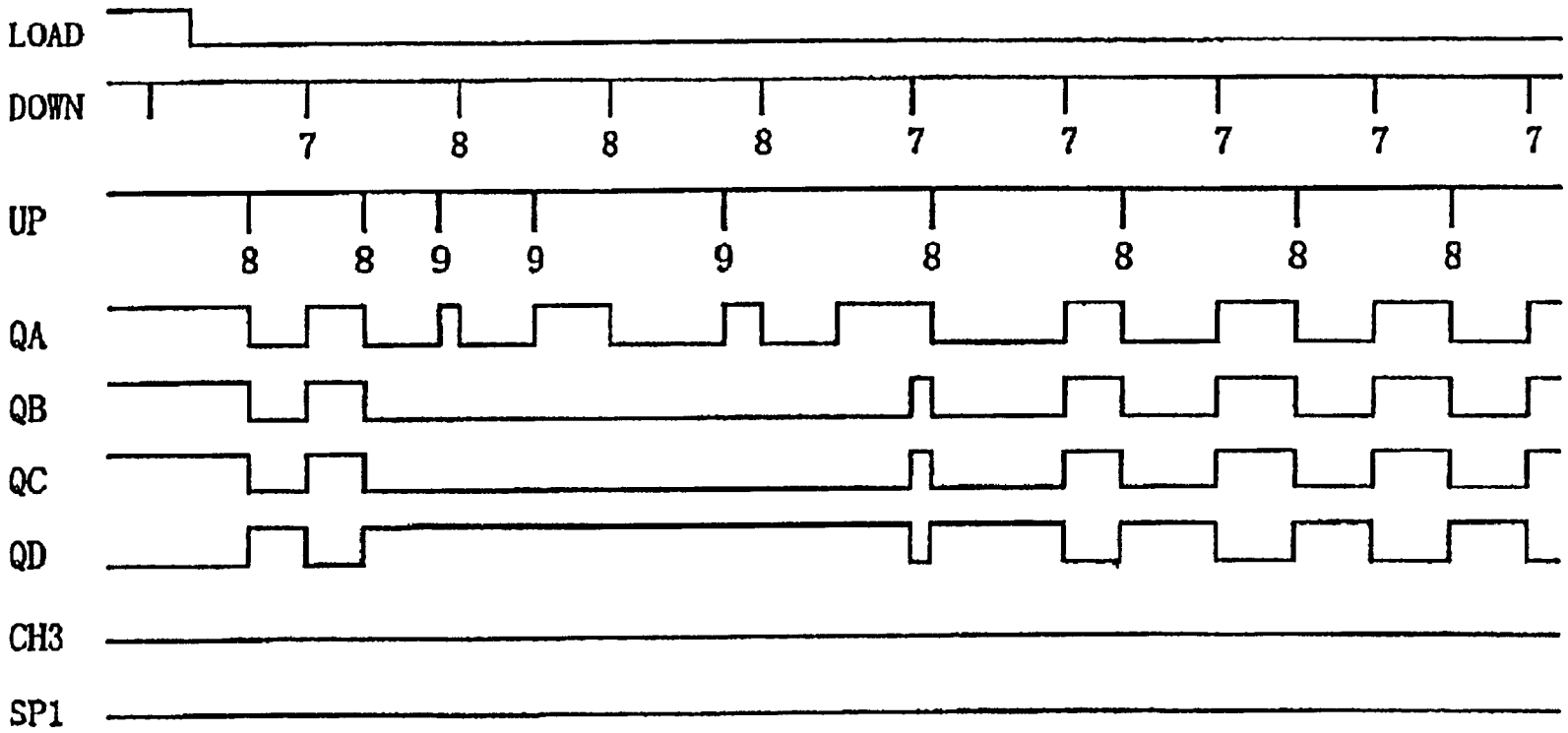

(FIG. 5)
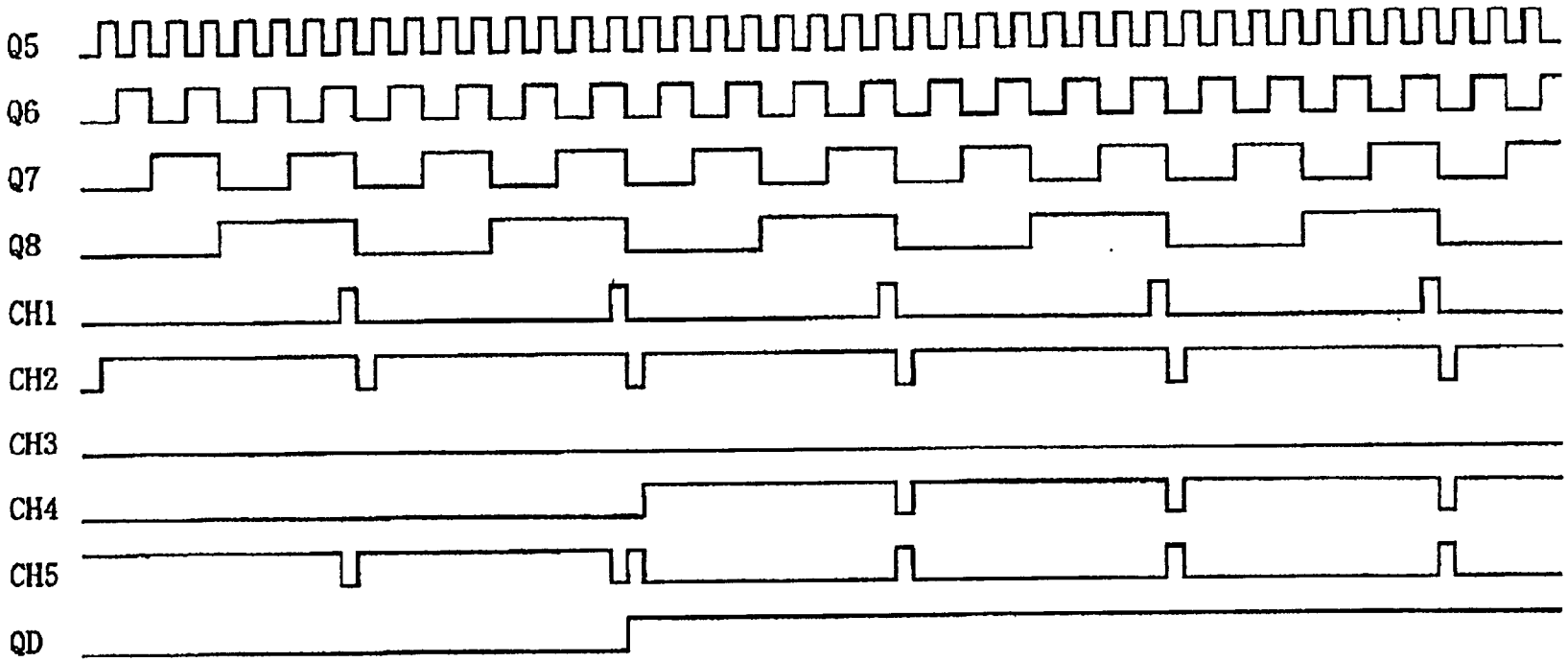

(FIG. 6)
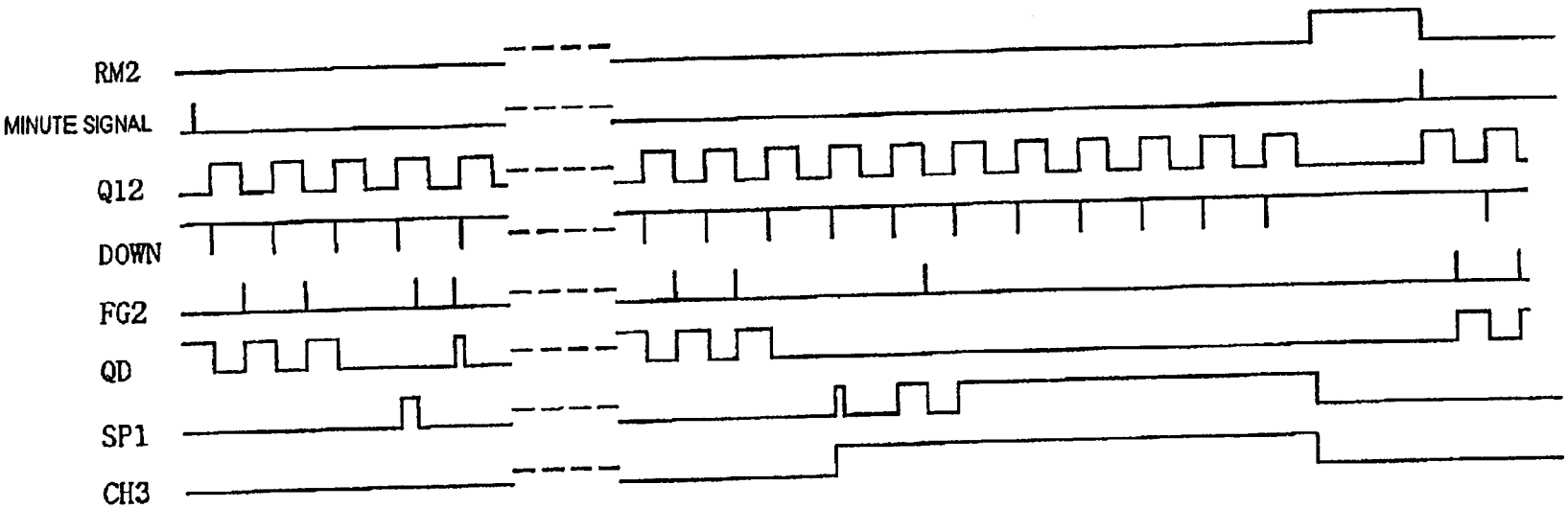

〔FIG. 7〕
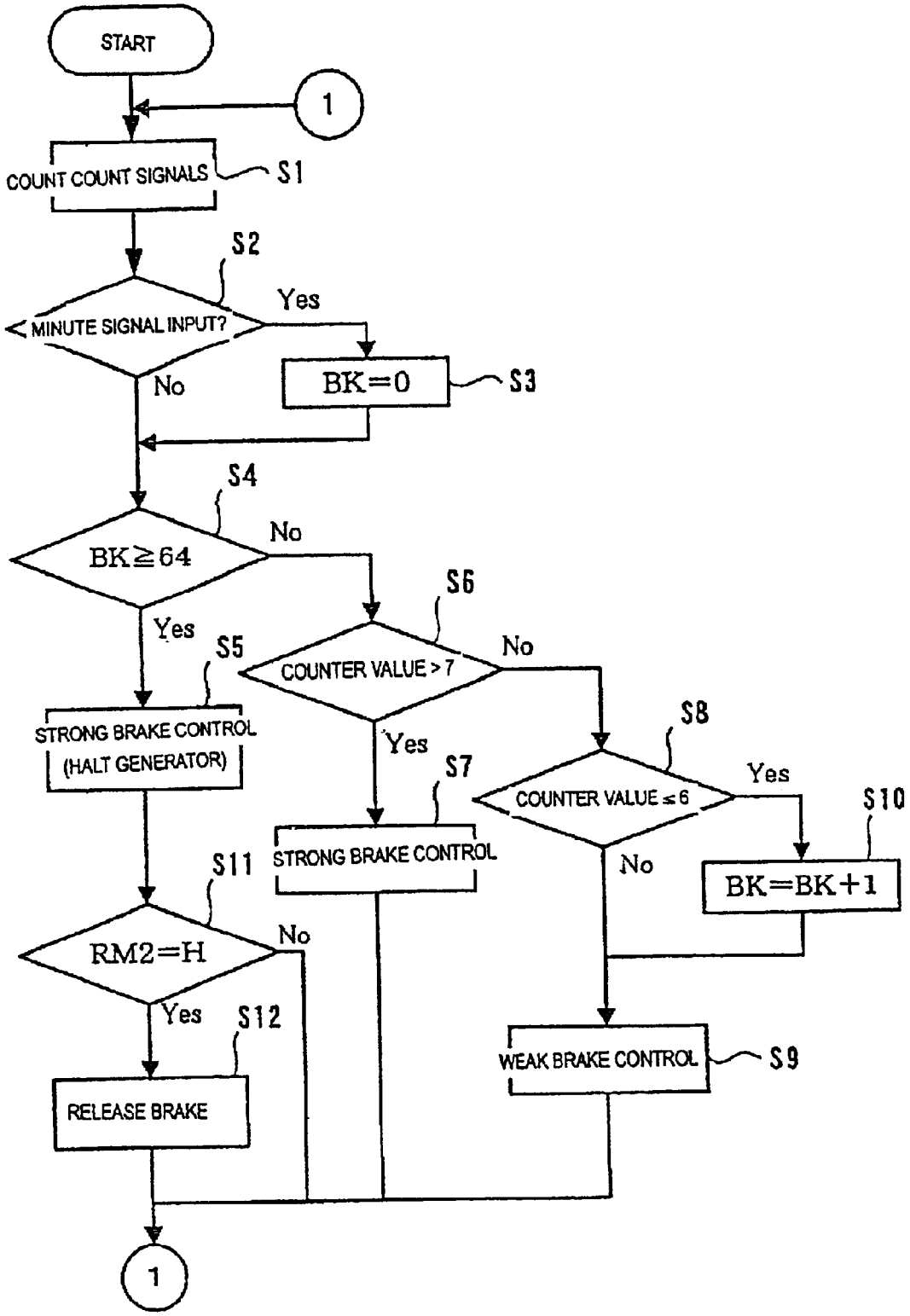

〔FIG. 8〕
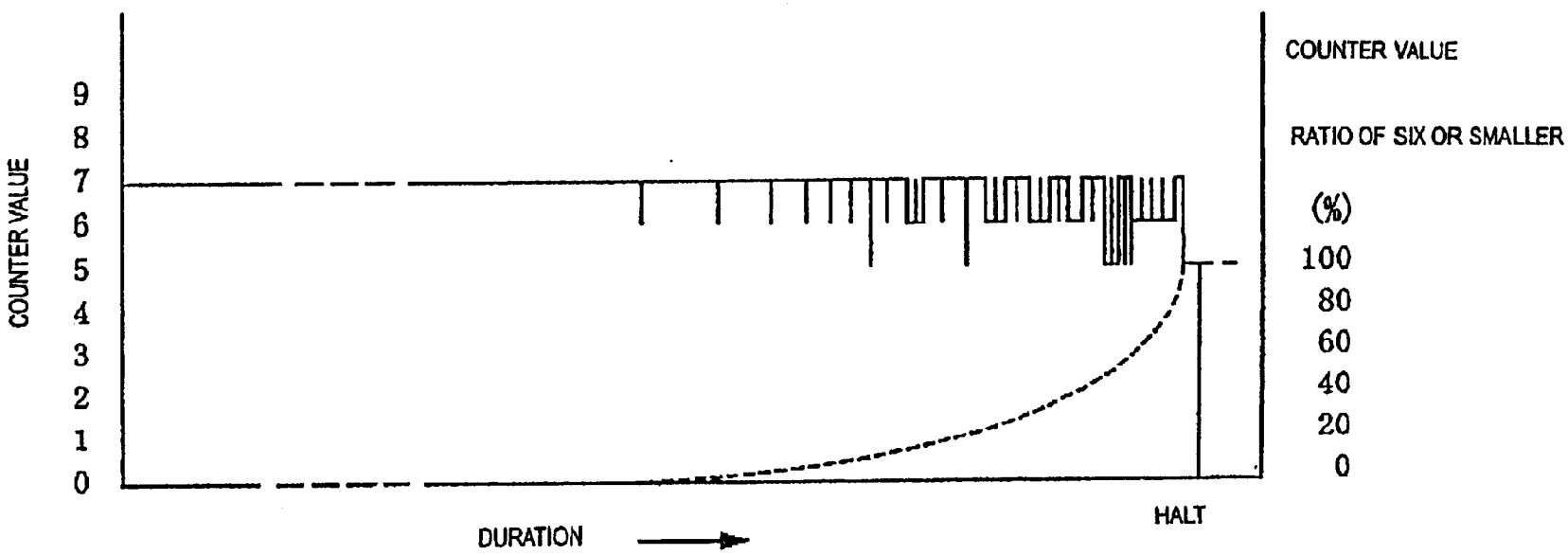

(FIG. 9)
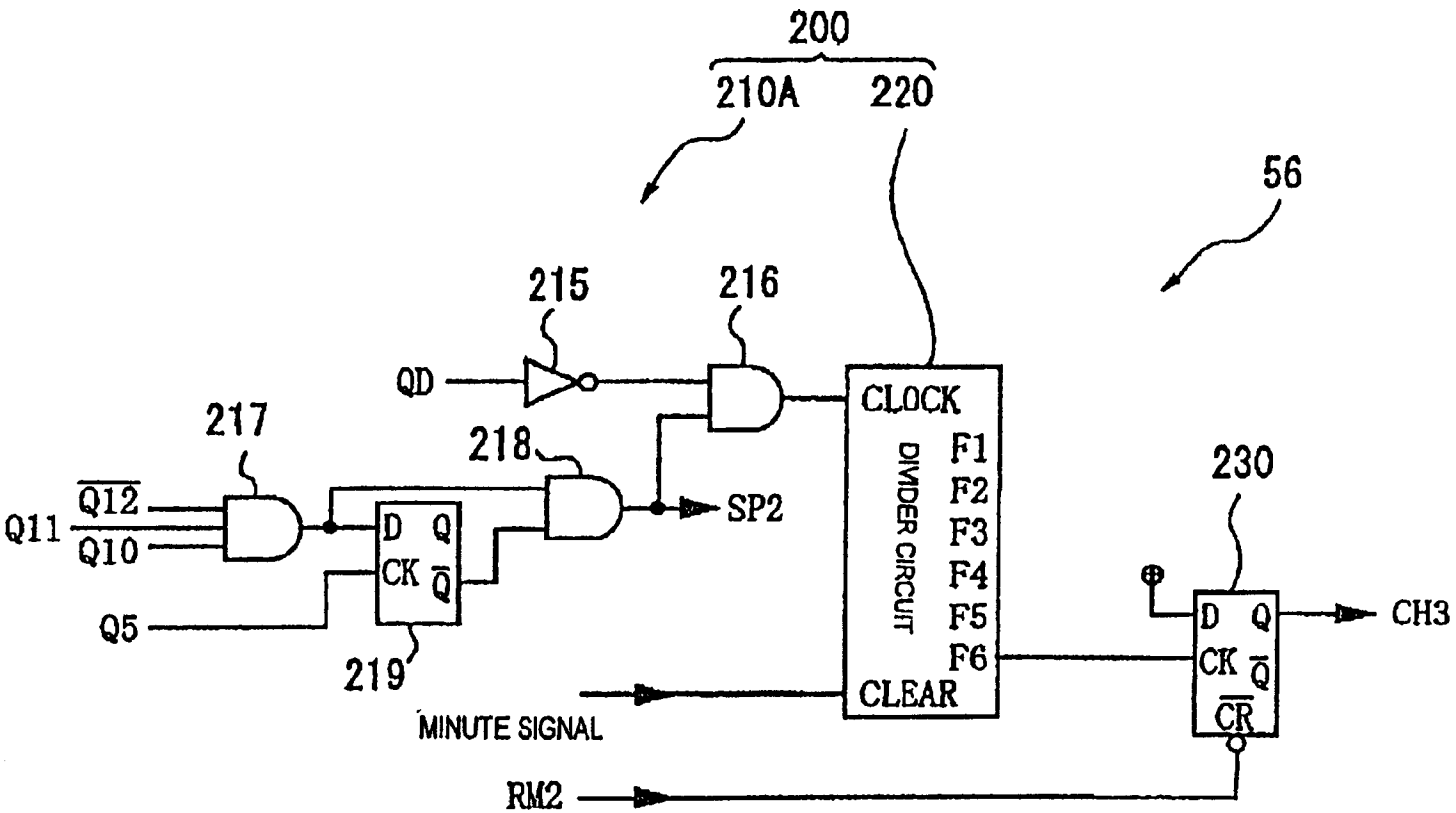

〔FIG. 10〕
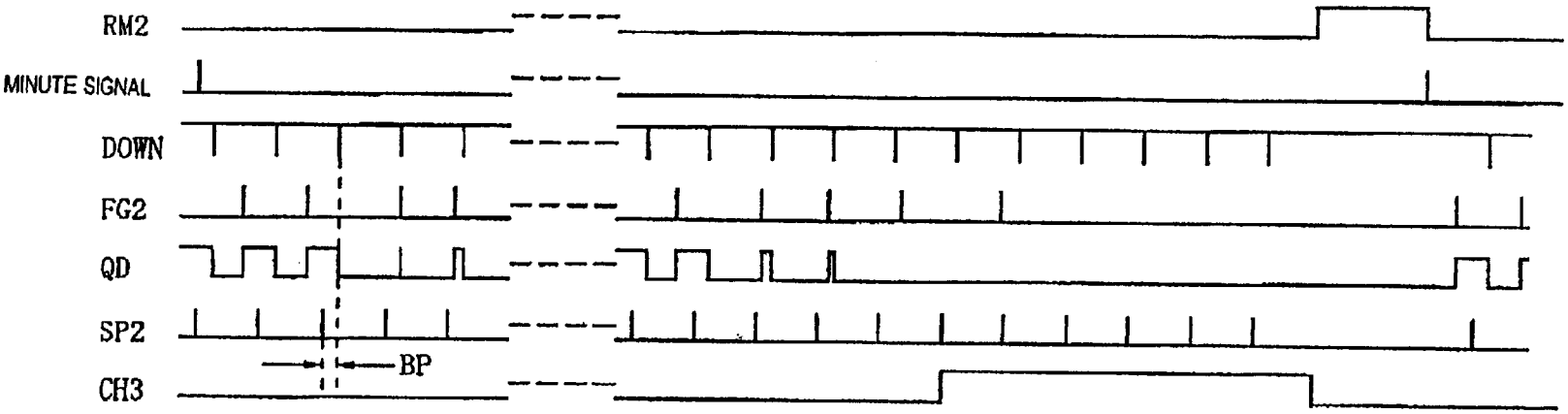

ELECTRONIC APPARATUS, ELECTRONICALLY CONTROLLED MECHANICAL TIMEPIECE, METHODS OF CONTROLLING THEM, PROGRAM FOR CONTROLLING ELECTRONIC APPARATUS, AND STORAGE MEDIUM

BACKGROUND OF THE INVENTION

1. Field of the Invention

The present invention relates to electronic apparatuses, electronically controlled mechanical timepieces, methods of controlling them, programs for controlling electronic apparatuses, and storage media, and more specifically, it relates to an electronic apparatus comprising a mechanical energy source; a generator which is driven by the mechanical energy source to generate an induced voltage and output an electric energy; and a rotation controlling unit which is driven by the electric energy to control the rotation rate of the generator; an electronically controlled mechanical timepiece, methods of controlling them, a program for controlling an electronic apparatus, and a storage medium.

2. Description of the Related Art

Japanese Patent No. 7-119812 discloses an electronically controlled mechanical timepiece in which mechanical energy released from a mainspring is converted into electric energy by a generator, and a rotation controlling unit is driven by the electric energy to control a current that flows through a coil in the generator, accurately driving hands fixed to a gear train and accurately indicating time.

In this electronically controlled mechanical timepiece, the arrangement is such that a torque (mechanical energy) applied to the generator by the mainspring can rotate the hands faster than a reference speed, and the rotation controlling unit governs the rotation rate by applying a brake. More specifically, the rotation rate of the generator is governed by comparing a rotation detection signal in accordance with the rotation rate of the generator with a reference signal generated in accordance with a signal from a time reference source such as a crystal resonator and setting a brake amount for the generator (e.g., a time for which a brake is applied).

However, when the mainspring is unwound and the spring force of the mainspring is diminished, failing to provide a sufficient rotation torque for the generator, the rotation rate of the generator is diminished, and the operation of hands becomes slow, and the time indication continues becoming slower for a long time.

In this case, the operation of hands is continued although it is slow; thus, there has been a problem that when the user of the timepiece takes a glance at the timepiece to check time, the user erroneously assumes a normal operation even though the time indication is incorrect.

In order to solve the above problem, as is described in Japanese Unexamined Patent Application Publication No. 2000-28757, herein incorporated by reference, the interval at which the rotation detection signal is input is made significantly larger than the interval at which the reference signal is input (reference period). It can then be determined that the rotation rate of the generator has diminished if the value of an up/down counter to which the reference signal and the rotation detection signal are input deviates significantly from a reference value, in which case the generator is halted and the user is thereby assuredly notified of a slower time indication.

For example, a four-bit up/down counter is provided, which counts down when the reference signal is input and counts up when the rotation detection signal is input. The counter applies a brake if the counter value is larger than or equal to "8" and releases the brake if the counter value is smaller than or equal to "7". If a large number of reference signals are input before the input of the rotation detection signal, so that the counter value becomes "2" or smaller, i.e., if the rotation rate is significantly diminished, a brake is applied to halt the generator.

However, depending on the type of electronically controlled mechanical timepiece, when the rotation rate is significantly diminished, the power generated by the generator is also sometimes diminished, failing to maintain a voltage which is capable of driving rotation controlling means constituted of ICs, etc., thereby causing the rotation controlling means to halt. When the rotation controlling means halts, brake control is not performed. Thus, even though the counter value is "2" or smaller, a brake cannot be applied to the generator, raising the possibility that the generator, and therefore the hands, cannot be halted with full assurance.

If the counter value at which the generator is halted is set to a larger value, for example, on the order of "4", the problem that the rotation controlling means halts and a brake control cannot be performed can be avoided. However, it has been found that the counter value can temporarily drop due to a disturbance, for example, and consequently shorten the duration resulting in the generator being halted.

The technique of actively halting the generator in case where a predetermined rotation rate cannot be maintained may be required not only in electronically controlled mechanical timepieces, but also in various electronic apparatuses such as music boxes, metronomes, toys, and electric razors which include portions rotated and controlled by a mechanical energy source such as a mainspring, rubber, etc. when a precise brake control is performed to precisely control operative portions such as a drum in a music box or a pendulum in a metronome, in which case there is also a possibility that the problem described above arises.

OBJECTS OF THE INVENTION

It is an object of the present invention to provide an electronic apparatus, an electronically controlled mechanical timepiece, methods of controlling them, a program for controlling an electronic apparatus, and a storage medium, in which the generator is assuredly halted when the rotation of the generator becomes slow, and the generator is not halted due to a temporary effect such as a disturbance, whereby the duration is extended accordingly.

SUMMARY OF THE INVENTION

An electronic apparatus in accord with the present invention includes a mechanical energy source; a generator which is driven by the mechanical energy source to generate an induced voltage and supply electric energy; and a rotation controlling unit which is driven by the electric energy to control the rotation rate of the generator; wherein the rotation controlling unit includes brake controlling means that performs a brake control for the generator by comparing a rotation detection signal indicative of the rotation rate of the generator with a reference signal generated in accordance with a signal from a time reference source; and generator halting means that applies a brake to halt the generator if the amount of braking applied to the generator by the brake controlling means in a preset time is smaller than, or equal to, a first braking preset value.

In the present invention, when mechanical energy supplied by the mechanical energy source (i.e. such as a mainspring) is high, the amount of braking applied to the generator in the preset time must be increased in order for the generator to maintain a constant rotation rate.

On the other hand, when the mechanical energy is low (such as when the mainspring being unwound), the amount of braking applied to the generator in the preset time must be decreased.

Thus, when the braking amount in the preset time becomes smaller than or equal to the first braking preset value, it is determined that the energy of the mechanical energy source itself has diminished, and the reduction is not due to a temporary disturbance. Thus, a brake is applied to the generator at that time, so that the duration is prevented from being significantly diminished by incorrectly halting the generator due to a disturbance.

Furthermore, because of the detection of a state in which the amount of braking by the brake controlling means in the rotation controlling unit is smaller than, or equal to, the first braking preset value(i.e., a state in which the brake controlling means is performing a normal brake control is detected), the situation, which has hitherto before been the case, that the rotation controlling unit is halted and a brake cannot be applied to the generator is avoided, and it can thus be assured that the generator can be halted.

The generator halting means preferably includes a braking amount detection means that detects the braking amount by counting the number of brake-off conditions for which a brake-off control is performed so that the brake controlling means does not apply a brake to the generator, and if the number of brake-off conditions in the preset time (as detected by the braking amount detection means) is larger than, or equal to, a preset number of times of brake-off conditions, it is determined that the braking amount in the preset time is smaller than or equal to the first braking preset value, whereby a brake is applied to halt the generator.

According to this invention, as above, the brake control for the generator is performed based on, for example, the phase difference between an 8-Hz reference signal and the rotation detection signal. Thus, for example, if the preset time is one minute, then the brake control is performed at least 8×60=480 times. The number of brake-off controls among them is then counted. If the number of brake-off controls is larger than or equal to a preset number of times of brake-off conditions (e.g., 64), the ratio of brake-off conditions is larger, so that it is determined that the braking amount is smaller than or equal to the first braking amount preset value, whereby the generator is halted.

At this time, the generator halting means can be readily controlled just by counting the number of brake-off conditions. In addition, just by setting the preset number of times of brake-off conditions as appropriate, the timing at which the generator is halted can be set in accordance with the characteristics of various electronic apparatuses, readily allowing control settings suitable for each of the electronic apparatuses.

The brake controlling means preferably includes an up/down counter to which one of the rotation detection signal or the reference signal is input as an up-count signal and the other is input as a down-count signal. The brake controlling means performs a control function to apply a brake to the generator when the value of the up/down counter becomes larger than a first counter preset value due to the rotation rate of the generator being faster and due to not applying a brake to the generator when the counter value becomes smaller than, or equal to, the first counter preset value. The braking amount detection means counts, as the number of brake-off conditions, the number of times the counter value of the up/down counter is smaller than, or equal to, a second counter preset value, which is smaller than the first counter preset value.

For example, the up/down counter has four bits, and the first counter preset value is "7". The brake-on control is performed when the counter value is larger than, or equal to, "8", and the brake-off control is performed when the counter value is smaller than, or equal to, "7". The second counter preset value is "6", and the number of "6" or smaller is counted as the number of brake-off conditions.

According to the arrangement as above, brake-off conditions can be recognized based on the value of the up/down counter, further facilitating the counting of the number of brake-off conditions.

The generator halting means may further include braking amount detection means that detects the braking amount by measuring the time during which a brake-on control is performed. In this way, when the brake controlling means applies a brake to the generator, it is possible to determined if the braking amount in the preset time is smaller than, or equal to, the first braking preset value by counting the number of short-brake applications (defined as application times shorter than a brake-on preset time) and determining if the number of short brake applications in the preset time (as detected by the braking amount detection means) is larger than, or equal to, a preset number of times of short-brake applications. If the braking amount in the preset time is indeed smaller than, or equal to, the first braking preset value, then a brake is applied to halt the generator.

According to this invention as above, the brake control for the generator is executed based on, for example, the phase difference between an 8-Hz reference signal and the rotation detection signal; thus, for example, if the preset time is one minute, then the brake control is performed at least 8×60=480 times. Each of the brake controls is performed based on the phase difference between the reference signal and the rotation detection signal, so that the time for the brake-on control is automatically adjusted in accordance with the phase difference.

At this time, the cases where the time for the brake-on control is smaller than or equal to the preset time is counted, and if this number is larger than, or equal to, a preset number of times of short brake applications (e.g., 64), then the ratio of short brake-on control is larger and it is determined that the braking amount is smaller than, or equal to, the first braking preset value, whereby the generator is halted.

At this time, the generator halting means is allowed to set two parameters, i.e., a first parameter indicative of the time of the brake-on control for controlling a short brake and a second parameter indicative of the preset number of times of short brake applications. In this manner, the timing at which the generator is halted can be set in accordance with the characteristics of various electronic apparatuses, and thus readily allowing control settings specially selected to suit each of the electronic apparatuses.

The brake controlling means may be capable of applying at least two types of brakes (a strong brake and a weak brake) to the generator. Preferably, the brake controlling means applies the weak brake to the generator when performing a brake-off control, and applies the strong brake to said generator when performing a brake-on control. Furthermore, the generator halting means preferably halts the generator when the brake controlling means applies the strong brake to said generator.

That is, the brake control may be performed by activating and deactivating (zero braking amount) the brake, or by using a large and a small brake.

At this time, in particular, two or more pulse signals having different duty ratios may be applied to switches that can turn ON and OFF both ends of a coil of the generator. In this manner, when a strong brake control is performed to apply a strong brake to the generator, the braking torque of the generator can be increased by applying a pulse signal with a large duty ratio (the switch is ON for a longer time) while suppressing reduction in power generation by means of the pulsing. On the other hand, when a weak brake control is performed to apply a weak brake to the generator, the braking torque of the generator can be minimized by applying a pulse signal with a duty ratio smaller than that of the above pulse signal to the switch (the switch is ON for a shorter time), serving to achieve a sufficient power generation.

Said rotation controlling unit preferably further includes a brake releasing means for releasing the brake that halts the generator. When a brake control operation is initiated to halt the generator, the brake control operation is maintained until the brake is released by the brake releasing means.

By providing the brake releasing means and requiring that the brake control operation be maintained until the brake is released by the brake releasing means, the generator will assuredly be maintained in a halt condition once the brake control operation is started until, for example, the mainspring (which is the mechanical energy source) is wound to return to a state in which a normal rotation is possible.

The brake releasing means preferably releases the brake that halts the generator when a user operates an external operation member, such as a crown, a dedicated button, etc.

By requiring the use of the external operation member to release the brake, it is assured that the brake is released when the user recognizes an abnormal rotation of the generator and operates the external operation member. Thus, the generator is maintained in a halt state by the brake control operation until the user recognizes an abnormality, and thus assuring that the abnormality is recognized.

The brake releasing means may further release the brake that halts the generator after the elapse of a preset time from following the application of the brake.

If the brake is applied for the predetermined time (e.g., on the order of four seconds) when the rotation rate of the generator is diminished, the rotation rate is hardly increased even if the brake is automatically released.

Thus, the user is assuredly notified of an abnormality, and the brake is automatically released, so that when the user reactivates the generator by winding the mainspring(or by some other pre-defined method) after noticing the abnormality, the reactivation goes smoothly and quickly because the brake is released, serving to improve activation characteristics. The predetermined time for which the brake is applied may be set as appropriate with consideration of the mechanical load and the torque of the mechanical energy source (such as the mainspring, etc.). The predetermined time may be set, for example, on the order of two to six seconds.

An electronically controlled mechanical timepiece according to the present invention includes: a mechanical energy source; a generator which is driven by the mechanical energy source to generate an induced voltage and supply electric energy; a rotation controlling unit driven by the electric energy to control the rotation rate of the generator; and a time indication unit that operates in association with the rotation of the generator. Preferably, the rotation controlling unit includes a brake control means and a generator halting means. The brake control means performs brake control on the generator as determined by a comparison of a rotation detection signal indicative of the rotation rate of the generator with a reference signal generated in accordance with a signal from a time reference source. The generator halting means halts the generator and halts the time indication unit if the amount of braking applied to the generator by the brake control means within a predetermined time period is smaller than, or equal to, a first, predetermined braking-amount value.

By applying the above-described electronic apparatus may be implemented as an electronically controlled mechanical timepiece, and when the rotation of the generator becomes slow, the generator is deliberately halted to stop the rotation thereof. In this manner the generator is prevented from operating when it is incapable of generating sufficient power. Furthermore, if a driven portion such as the hands of the timepiece is operatively linked to the generator so that the driven portion is controlled in accordance with the rotation of the generator, it can be assured that hand control is accurately performed without error whenever the generator is in operation. Additionally, and the generator is assuredly halted when the rotation rate of the generator is diminished, whereby the user is unmistakably notified that the timepiece is slow.

The above-described electronic apparatus may be a timekeeping device, a music box, or a metronome. In the timekeeping device, the music box, or the metronome, the generator is prevented from being halted due to a disturbance or other transient event, the rotation thereof is accurately controlled when in operation, and the operation is assuredly halted when the torque of the mechanical energy source is diminished to the point where it fails to maintain an accurate rotation.

When the electronic apparatus is an electronically controlled mechanical timepiece, the above-described external operation member is preferably a crown. More specifically, said rotation controlling unit preferably includes brake releasing means for releasing the brake that halts the generator, and includes brake releasing means releases the brake when a user operates the crown.

In the case of an electronically controlled mechanical timepiece, the hands operate in association with the generator, and when the user recognizes an abnormal operation of hands, the user usually rotates the crown to wind the mainspring. Thus, by making the arrangement such that the brake control for halting the generator (hands) is released when the crown is operated, the user is not required to perform an extra operation for releasing the brake by separately pressing a dedicated button, etc., which serves to improve operability.

A method of controlling an electronic apparatus according to the present invention controls an electronic apparatus that includes a mechanical energy source; a generator driven by the mechanical energy source to generate an induced voltage and supply electric energy; and a rotation controlling unit driven by the electric energy to control the rotation rate of the generator. Determination of when to apply brake control on the generator is made by comparing a rotation detection signal in accordance with the rotation rate of the generator with a reference signal generated in accordance with a signal from a time reference source. The brake is applied to halt the generator if the amount of braking applied to the generator in within a predetermined time period is smaller than or equal to a first braking preset value.

According to this invention as well, when the amount of braking on the generator becomes smaller than or equal to the first braking preset value, i.e., when the rotation rate becomes very slow, a brake is applied to assure that the generator is stopped. Thus, failure to provide a sufficient power generation due to the rotation of the generator being too slow is prevented.

A method of controlling an electronically controlled mechanical timepiece according to the present invention controls an electronically controlled mechanical timepiece that has: a mechanical energy source; a generator driven by the mechanical energy source to generate an induced voltage and supply electric energy; a rotation controlling unit that is driven by the electric energy to control the rotation rate of the generator; and a time indication unit that operates in response to the rotation of said generator. In the present invention, determination of when to apply brake control on the generator is made by comparing a rotation detection signal in accordance with a rotation rate of the generator with a reference signal generated in accordance with a signal from a time reference source, and a brake mechanism is applied to assure that the generator and said time indication unit is halted if the amount of braking applied to said generator by the brake control within a predetermined time period is smaller than or equal to a first braking preset value.

According to this invention as well, when the amount of braking on the generator by the brake control becomes smaller than, or equal to, a first predetermined braking value (i.e. when the rotation rate becomes very slow), the brake is applied to assure that the generator is stopped.

Accordingly, when the rotation of the generator becomes very slow and an error occurs in the time indication unit such as hands operatively associated with the generator, the generator, and therefore the time indication unit, are halted. Thus, an abnormal operation of hands can be recognized when the user takes a glance at the hands, or otherwise checks time, whereby the user is notified that the timepiece is slow. This prevents the user from using the timepiece while leaving the slow timepiece as it is, and prompts the user to perform an operation for winding the mainspring, thereby returning the electronically controlled mechanical timepiece to a normal operation.

A program for controlling an electronic apparatus according to the present invention controls an electronic apparatus having: a mechanical energy source; a generator driven by the mechanical energy source to generate an induced voltage and supply an electric energy; and a rotation controlling unit driven by the electric energy to control the rotation rate of the generator. The program lets the rotation controlling unit function as brake controlling means that applies brake control on the generator as determined by comparing a rotation detection signal in accordance with the rotation rate of the generator with a reference signal generated in accordance with a signal from a time reference source. The electronic apparatus further includes generator halting means applies a brake to halt the generator if the amount of braking applied to the generator by the brake controlling means within a predetermined time period is smaller than, or equal to, a first braking preset value.

A storage medium according to the present invention stores a program for controlling an electronic apparatus having: a mechanical energy source; a generator driven by the mechanical energy source to generate an induced voltage and supply electric energy; and a rotation controlling unit driven by the electric energy to control the rotation rate of the generator. The program lets the rotation controlling unit function as a brake controlling means that applies brake control on the generator as determined by comparing a rotation detection signal in accordance with the rotation rate of the generator with a reference signal generated in accordance with a signal from a time reference source. The electronic apparatus further includes generator halting means applies a brake to halt the generator if the amount of braking applied to the generator by the brake controlling means within a predetermined time period is smaller than, or equal to, a first, predetermined braking value.

By installing on an electronic apparatus the control program according to the present invention via the storage medium or communications means such as the Internet, a brake can be applied to halt the generator when the rotation of the generator becomes slow and the braking amount becomes smaller than, or equal to, the first predetermined braking value, whereby an accurate rotation control is achieved when the generator is in operation.

In addition, because the program can be installed and embedded on an electronic apparatus via a storage medium such as a CD-ROM or communications means such as the Internet, the first braking preset value, i.e. the first predetermined braking value, can be readily and optimally set (or changed) in accordance with the characteristics of various electronic apparatuses, achieving an even more accurate rotation control.

Other objects and attainments together with a fuller understanding of the invention will become apparent and appreciated by referring to the following description and claims taken in conjunction with the accompanying drawings.

BRIEF DESCRIPTION OF THE DRAWINGS

In the drawings wherein like reference symbols refer to like parts.

FIG. 1 Block diagram showing the construction of the main parts of an electronically controlled mechanical timepiece according to a first embodiment of the present invention;

FIG. 2 Circuit diagram showing the construction of the electronically controlled mechanical timepiece according to the embodiment;

FIG. 3 Circuit diagram showing the construction of a generator halting unit in the embodiment;

FIG. 4 Timing chart of an up/down counter in the embodiment;

FIG. 5 Timing chart of a chopper, i.e. pulse, signal generating unit in the embodiment;

FIG. 6 Timing chart of the chopper, i.e. pulse, signal generating unit and the generator halting unit in the embodiment;

FIG. 7 Flowchart for explaining an operation in the embodiment;

FIG. 8 Graph showing the relationship between the counter value of the up/down counter and duration in the embodiment;

FIG. 9 Circuit diagram showing the construction of a modified generator halting unit suitable for the embodiment; and FIG. 10 Timing chart of a pulse, or chopper, signal generating unit and the generator halting unit in FIG. 9.

DESCRIPTION OF THE PREFERRED EMBODIMENTS

FIG. 1 is a block diagram showing an electronically controlled mechanical timepiece according to an embodiment of the present invention.

The electronically controlled mechanical timepiece includes a mainspring 1 as a source of mechanical energy, a step-up gear train 3 as an energy transmitting device for transmitting a torque of the mainspring 1 to a generator 2, and hands 4 for indicating time, which are linked to the step-up gear train.

The generator 2 is driven by the mainspring 1 via the step-up gear train 3 to generate an induced voltage and supply electrical energy. An AC output from the generator 2 is boosted and rectified in a rectifying circuit 5 (preferably implemented as any of a booster rectifier, a full-wave rectifier, a half-wave rectifier, a transistor rectifier, etc.), and the output of rectifying circuit 5 is supplied to a power supply circuit 6 (preferably implemented as a capacitor, battery, etc.).

In this embodiment, as shown in FIG. 2, a braking circuit 20 including rectifying circuit 5 is provided in generator 2. The braking circuit 20 includes a first switch 21 connected to a first AC input terminal MG1 to which an AC signal (AC current) is input, and a second switch 22 connected to a second AC input terminal MG2 to which the AC signal is input. When both of switches 21 and 22 are closed, i.e. turned on, the first and the second AC input terminals MG1 and MG2 are shorted together to form a closed loop, whereby a short brake is applied.

The first switch 21 is implemented by a parallel connection of a first P-channel FET (field-effect transistor) 26 and a second P-channel FET 27. The gate of first P-channel FET 26 is connected to the second AC input terminal MG2, and the gate of second P-channel FET 27 receives a chopper signal (i.e. pulse signal) CH5 from a chopper signal generating unit 80 to be described later.

Second switch 22 is implemented by a parallel connection of a third P-channel FET (field-effect transistor) 28 and a fourth P-channel FET 29. The gate third P-channel FET 28 is connected to the first AC input terminal MG1, and the gate of fourth P-channel FET 29 receives chopper signal CH5 from chopper signal generating circuit 80.

The voltage doubler rectifier circuit 5 includes a capacitor 23 for voltage boosting, diodes 24 and 25, and switches 21 and 22. Diodes 24 and 25 may be of any type as long as they are unidirectional devices, which allow current to flow only in one direction. In particular in an electronically controlled mechanical timepiece, because the electromotive force of generator 2 is small, Schottky barrier diodes or silicon diodes, which have small voltage Vf and reverse leakage current, are preferably used as the diodes 24 and 25. The rectified DC signal produced by rectifier circuit 5 charges power supply circuit 6 (preferably implemented as a capacitor), as shown in FIG. 1.

The braking circuit 20 of FIG. 2 is controlled by a rotation controlling unit 50 driven, shown in FIG. 1, which is supplied with power supplied from the power supply circuit 6. Rotation controlling unit 50 includes an oscillation circuit 51, a detection circuit 52, and a control circuit 53.

As better shown in FIG. 2, oscillation circuit 51 outputs an oscillation signal (preferably of 32,768 Hz) using a crystal resonator 51A, which serves as a time reference source. The oscillation signal is divided to a predetermined period by a divider circuit 54, preferably constructed of flip-flops in twelve stages. The output Q12 at the twelfth stage of divider circuit 54 is output as an 8-Hz reference signal, fs.

Detection circuit 52 includes a waveform shaping circuit 61 connected to generator 2, and a monostable multivibrator 62. The waveform shaping circuit 61 is constituted of amplifiers and comparators, and it converts a sine wave into a rectangular wave. The monostable multivibrator 62 functions as a band-pass filter that only passes pulses of a predetermined period or below, and outputs a rotation detection signal FG1 which is cleared of noise.

With reference to FIG. 1, control circuit 53 includes a brake controlling unit 55 (which constitutes brake controlling means), a generator halting unit 56 (which constitutes generator halting means), and a brake releasing unit 57 (which constitutes brake releasing means).

Returning to FIG. 2, brake controlling unit 55 includes an up/down counter 60, a synchronization circuit 70, and a chopper signal (i.e. pulse signal) generating unit 80.

Rotation detection signal FG1 from the detection circuit 52 and reference signal fs from the divider circuit 54 are respectively coupled to the up-count input and the down-count input of up/down counter 60 via synchronization circuit 70.

Synchronization circuit 70 includes four flip-flops 71 and multiple AND gates 72 and 73. Synchronization circuit 70 synchronizes rotation detection signal FG1 with reference signal fs (8 Hz) using signals from the fifth stage output Q5 (preferably at 1,024 Hz) and the sixth stage output Q6 (preferably at 512 Hz) of divider circuit 54, while coordinating the signal pulses so as not to overlap each other at its outputs.

The up/down counter 60 is preferably implemented using a four-bit counter. A signal from the synchronization circuit 70 in accordance with rotation detection signal FG1 is input to the up-count input of up/down counter 60. A second signal from synchronization circuit 70 in accordance with the reference signal fs is input to down-count input of up/down counter 60. Thus, the frequency difference between reference signal fs and rotation detection signal FG1 can be directly obtained by simultaneously counting the signals.

The up/down counter 60 has four data input terminals (preset terminals) A to D, and the initial value (i.e. preset value, or predetermined value) of the up/down counter 60 is preferably set to seven, "7", by inputting high logic level (i.e. H-level) signals to terminals A to C and applying a low logic level (i.e. L-level or VSS level) to terminal D.

An initialization circuit 90 is connected to power supply circuit 6 across lines VDD and VSS, as shown in FIG. 2, and outputs a system reset signal SR in accordance with the charge voltage (i.e. the charge level) of power supply circuit 6. System reset signal SR is connected to the LOAD input terminal of up/down counter 60. In this embodiment, initialization circuit 90 outputs an H-level signal until the charge voltage of power supply circuit 6 reaches a predetermined voltage (i.e. a predetermined charge level), and outputs an Level signal as long as a charge voltage level not smaller than the predetermined voltage is maintained.

The up/down counter 60 does not accept any up or down inputs and maintains a count value of "7" until its LOAD input receives an L-level signal, i.e., until the system reset signal SR is output,.

The up/down counter 60 has a four-bit output, QA to QD. Thus, the fourth-bit output QD outputs an L-level signal if the counter value is smaller than, or equal to, the first counter preset value of "7", and QD outputs an H-level signal if the counter value is larger than, or equal, to "8". The output QD is connected to chopper signal generating unit 80.

Outputs QA to QD are input to NAND gate 74 and OR gate 75, and the outputs of NAND gate 74 and OR gate 75 are respectively input to NAND gates 73, to which outputs from the synchronization circuit 70 are input. Thus, for example, if a plurality of up-count signals is continuously received to make the counter output value "15", NAND gate 74 will output an L-level signal, canceling any further inputs of up-count signals to NAND gate 73, thereby inhibiting further input of up-count signals to the up/down counter 60. Similarly, when the counter value becomes "0", the OR gate 75 outputs an L-level signal, whereby further input of down-count signals is cancelled. Accordingly, the counter value does not turn from "15" to "0" or from "0" to "15".

Chopper signal generating unit 80 includes an AND gate 82 which outputs a first chopper signal CH1 using the outputs Q5 to Q8 of the divider circuit 54, an OR gate 83 which outputs a second chopper signal CH2 using the outputs Q5 to Q8 of the divider circuit 54, an OR gate 86 to which the output QD of the up/down counter 60 is input, an AND gate 84 to which the output of the OR gate 86 and the chopper signal CH2 is input, and a NOR gate 85 to which the output CH4 of the AND gate 84 and the output CH1 are input.

Output CH5 from NOR gate 85 in chopper signal generating unit 80 is input to the gates of the P-channel transistors 27 and 29. Thus, transistors 27 and 29 remain turned on while the chopper output CH5 is at L-level, so that a short circuit is caused in generator 2, which effectively applies the brake.

On the other hand, transistors 27 and 29 remain turned off while the output CH5 is at H-level, not applying the brake on the generator 2. Thus, generator 2 can be pulsed-controlled in accordance with chopping signal CH5 from the output of NAND gate 85.

The duty ratio (i.e. duty cycle) of each of chopper signals CH1 and CH2 is the ratio of time during which the brake is applied to generator 2 during a single period of the chopper signal, and in this embodiment, it is the ratio of time when each of chopper signals CH1 and CH2 is at H-level during a single period.

As shown in FIG. 3, the generator halting unit 56 includes a braking amount detection circuit 200 (which constitutes braking amount detection means) and a generator halting signal output circuit 230, which outputs a signal CH3 for halting the generator 2 in accordance with a braking amount detected by the braking amount detection circuit 200.

The braking amount detection circuit 200 includes a counter value detection circuit 210 and a divider circuit 220. The counter value detection circuit 210 outputs, in each reference period, a H-level signal if the counter value of the up/down counter 60 is smaller than, or equal to, "6", which is a second counter preset value, and a L-level signal if the counter value is larger than, or equal to, "7". Divider circuit 220 constitutes an accumulation means for counting H-level signals from the counter value detection circuit 210, and accumulate the braking amount (the number of brake-off conditions).

More specifically, the counter value detection circuit 210 includes an AND gate 211 to which the outputs QA to QC of the up/down counter 60 are input, a NOR gate 212 to which the output of the AND gate 211 and the output QD of the up/down counter 60 are input, and an AND gate 213 to which the output SP1 of the NOR gate 212 and the output Q12 of the divider circuit 54 are input.

Thus, the output SP1 of the NOR gate 212 becomes an H-level signal if the counter value of the up/down counter 60 is "0" to "6", i.e., smaller than or equal to the second counter preset value of "6".

The generator halting signal output circuit 230 is implemented by a flip-flop which drives the generator halting signal CH3 to H-level when the number of H-level signals counted by the divider circuit 220 in the predetermined period (the number of brake-off conditions) becomes larger than or equal to a predetermined number (the preset number of times of brake-off conditions), which cause output F6 to be driven to H-level.

In the generator halting unit 56 described above, when SP1 is at H-level, the AND gate 213 outputs a signal, which is synchronized with the output Q12 (i.e., an 8-Hz signal just as the reference signal), to the clock input of the divider circuit 220.

A minute signal is input to the clear input of the divider circuit 220 at one-minute intervals, as determined by divider circuit 54 of FIG. 2.

Thus, the divider circuit 220 outputs a H-level signal to the clock input of the flip-flop 230 if a predetermined number of H-level signals are input to divider circuit 220 from AND gate 213 within a one minute period (i.e., before divider circuit 220 is cleared by the minute signal).

In this embodiment, when 64 (the preset number of times of brake-off conditions) or more H-level signals are input to the clock input of divider circuit 220 in one minute, divider circuit 220 outputs a H-level signal on output node F6 to the input of flip-flop 230.

The flip-flop 230, which is the generator halting signal output circuit, has a clear input receiving a signal RM2 that is driven to H-level when the crown is at a second tier position, i.e., when time indication is to be corrected. Flip flop 230 also has a data input, to which a H-level signal is constantly applied, and a clock input, to which the output F6 of divider circuit 220 is input.

Thus, the output Q of the flip-flop 230 outputs a H-level signal from the time that the output F6 is driven to H-level until the time that the crown is pulled out to the second tier position. The H-level signal from flip-flop 230 serves as generator halting signal CH3.

That is, the generator halting signal CH3 is driven to H-level if a brake-off control is performed with the value of the up/down counter 60 being smaller than or equal to the second counter preset value of "6", i.e. 64 times or more in one minute.

Returning to FIG. 2, the generator halting signal CH3 is input to the OR gate 86 together with the output QD. Thus, when the generator halting signal CH3 is at L-level, the output QD is directly transferred to the output of OR gate 86, so that a strong brake control is performed if the output QD is an H-level signal, i.e., if the counter value of up/down counter 60 is larger than or equal to "8", while a weak brake control is performed if the counter value is smaller than or equal to the first counter preset value of "7".

When the generator halting signal CH3 is at H-level, a strong brake is constantly applied irrespective of output QD.

In the present invention, a strong brake and a weak brake are relative, and the strong brake indicates a stronger braking force than the weak brake. The specific braking force, i.e., the duty ratio or frequency of the chopper braking signal, for each of the brakes may be determined as appropriate in its specific implementation.

In this embodiment, flip-flop 230 is cleared and the generator halting signal CH3 is driven to L-level when signal RM2 is driven to H-level. Thus, the crown and flip-flop 230 in generator halting unit 56 constitute the brake releasing unit 57 of FIG. 1.

Next, an operation in this embodiment will be described with reference to timing charts shown in FIGS. 4 to 6 and a flowchart shown in FIG. 7.

When generator 2 starts operating and initialization circuit 90 applies an L-level system reset signal SR to the LOAD input of up/down counter 60, the up/down counter 60 counts up the signals at its up-count input, which are applied in accordance with rotation detection signal FG1, and count down the signals at its down-count input, which are applied in accordance with reference signal fs, as shown in FIG. 4 (step 1, and step will be hereinafter designated simply as "S"). The arrangement is made such that synchronization circuit 70 does not input these signals simultaneously to up/down counter 60.

Thus, when a signal is applied to the up-count input in, a state where the initial counter value is set to "7", the counter value becomes "8", whereby the output QD outputs a H-level signal to OR gate 86.

When a signal is applied to the down-count input and the counter value returns to "7", the output QD outputs a L-level signal.

Chopper signal generating unit 80 outputs chopper signals CH1 and CH2 using outputs Q5 to Q8 of divider circuit 54, as shown in FIG. 5.

Upon reception of the minute signal (S2), divider circuit 220 in generator halting unit 56 is reset (S3). If brake-off condition parameter BK designates the number of times a brake-off control signal is issued with the counter value of up/down counter 60 being smaller than, or equal to, the second counter preset value of "6", then a reset operation of divider circuit 220 initializes "BK=0" (S3).

In divider circuit 220, when the braking amount becomes larger than, or equal to, the preset value (i.e., when the number of brake-off conditions BK becomes larger than or equal to the preset number of times of brake-off conditions (64), shown in step S4), a strong brake control is performed to halt generator 2 (S5).

If the braking amount is smaller than the preset value (BK<64) (S4), the generator halting signal CH3 remains an L-level signal. At this time, if the counter value of up/down counter 60 is "8" or larger (i.e., if output QD is an H-level signal (S6)), chopper signal CH2 is directly transferred from the input of AND gate 84 to its output, and output CH4 becomes the same as chopper signal CH2. Thus, output CH5 of NOR gate 85 becomes a chopper signal that is the inverse of output CH2. In other words, it becomes a chopper signal with a large duty ratio (15/16) for performing strong brake control (i.e. it has a short H-level period (brake-off period) of 1/16 and a long L-level period (brake-on period) of 15/16).

Thus, chopper signal CH5 has at L-level for a large cumulative time period, which applies a short brake on generator 2, whereby a strong brake control is performed on generator 2 (S7). At this time, the chopper signal CH5 becomes an H-level signal by a predetermined cycle to deactivate the short brake, achieving chopping control, so that the braking torque will be improved while preventing a reduction in power generation.

If the braking amount is smaller than the preset value (S4) and if the counter value of up/down counter 60 is smaller than or equal to the first counter preset value of "7" (S6), output QD is an L-level signal and thus output CH4 is also an L-level signal. Thus, as shown in FIG. 5, output CH5 from NOR gate 85 becomes a chopper signal that is the inverse of output CH1. That is, it is a chopper signal with a small duty ratio of 1/16 (the ratio of time when switches 21 and 22 are turned on), i.e. with a long H-level period (brake off period) of 15/16 and a short L-level period (brake on period) of 1/16. Accordingly, a weak brake control with a priority given to power generation is performed on the generator 2 (S9).

At this time, if the counter value of up/down counter 60 is smaller than or equal to the second counter preset value of "6" (S8), H-level signals are input to the clock input of divider circuit 220 and counted, and a process for incrementing the parameter BK by one is also performed (S10).

The process based on the counter value is repeated, and if 64 H-level signals are input before application of the minute signal to drive output F6 of divider circuit 220 to H level, i.e., if the parameter BK becomes 64 or larger, a strong brake control is performed to halt generator 2 (S5). That is, because output Q12 is at 8 Hz, 480 signals are output in one minute, and if 64 or more of those signals are H-level signals (the counter value is smaller than or equal to "6" by approximately 13%), a strong brake control is performed.

More specifically, when output F6 is driven to H-level, output CH3 of flip-flop 230 becomes an H-level signal, so that a strong brake control is maintained irrespective of the signal logic level at output QD, whereby generator 2 is halted (S5).

The strong brake control, which halts generator 2, is maintained until signal RM2 is driven to H-level, i.e., until the crown is pulled out to the second tier (S11). When signal RM2 is driven to H-level, the brake is released (S12).

To sum up the operation described above, in a state where generator halting signal CH3 is an L-level signal, while output QD of up/down counter 60 is at an H-level, a strong brake control in accordance with a chopper signal with a large duty ratio is performed. On the other hand, while output QD of up/down counter 60 is at an L-level, a weak brake control in accordance with a chopper signal with a small duty ratio is performed. That is, up/down counter 60, which constitutes a brake controlling unit, switches between the strong brake control operation and the weak brake control operation.

When the brake control as described above is being repeated, generator 2 rotates substantially at a preset rate, and as shown in FIG. 4, up-count signals and down-count signals are alternately input, whereby a locked state is entered in which the counter value alternates between "8" and "7". Also in this case, the strong brake control and the weak brake control are repeated in accordance with the counter value and the rotation rate.

When the torque of mainspring 1 is decreased, the ratio of the counter value of up/down counter 60 being smaller than or equal to "6" increases, as shown in FIG. 8. When the ratio reaches a predetermined value in one minute (larger than or equal to 64/480), a strong brake control is performed irrespective of output QD. The strong brake control is continued until the crown is pulled out to the second tier, so that generator 2 is assuredly halted.

Thus, the hands are halted for sure, and an abnormal operation of hands can be recognized when the user looks at the hands 4 to check the time. When the user pulls out the crown to the second tier, the brake on the generator 2 is released.

The embodiment described above provides the following advantages:

(1) Because the rotation controlling unit 50 includes the generator halting unit 56 in addition to the brake controlling unit 55 for performing brake control for ordinary speed governing, a brake can be continuously applied to halt the generator 2, for example, when the torque of the mainspring 1 is diminished, the rotation rate of the generator 2 becomes slower than the reference rate, and the operation of hands becomes slower to cause an error in the indication of time. Thus, when the timepiece is not operating correctly, the operation of hands can be stopped, and the user of the timepiece is allowed to readily and correctly recognize the incorrect operation of hands when checking time, serving to use the electronically controlled mechanical timepiece with an accurate speed governing.

(2) When the generator halting unit 56 generates the generator halting signal CH3 for halting the generator 2, determination is made based on the ratio of the counter value of the up/down counter 60 being smaller than or equal to the second counter preset value of "6" in the preset time (one minute in this embodiment), so that the generator 2 will not be incorrectly halted, for example, when the counter value of the up/down counter 60 is decreased due to a temporary disturbance. Thus, the generator 2 is halted correctly only when the mainspring 1 is released and the torque is diminished.

Accordingly, the duration is prevented from being diminished due to the generator 2 being halted by a brake which is applied during a disturbance, serving to ensure the duration of the electronically controlled mechanical timepiece as it is designed.

Furthermore, the generator 2 is prevented from once being halted and then deactivated, reducing error in the time indication by the hands 4.

(3) The arrangement is such that braking by the generator halting unit 56 is not released until the user pulls the crown out to the second tier, serving to maintain a state which allows recognition that the operation of hands is halted.

The brake can be released by pulling the crown out to the second tier, and thus the brake can be released when correcting the time indicated by the hands 4 or winding the mainspring 1, allowing smooth operations.

The brake is released only when the user recognizes an incorrect operation of hands and pulls out the crown, so that the user can correctly recognize an incorrect operation of hands.

(4) The brake is released using the crown, so that the operation for releasing the brake will be easier compared with a case where a dedicated button, etc. are provided separately. More specifically, when the user recognizes an incorrect operation of hands, the user usually winds the mainspring 1 by rotating the crown; thus, by arranging so that the brake for halting the generator 2 is also released when the crown is operated, the user does not have to perform an operation for releasing the brake by separately depressing a dedicated button, etc., serving to improve operability.

When a brake is applied to the generator 2 operatively associated with the hands 4, even if the crown is pushed in after the crown is pulled out and the time indicated by the hands 4 is corrected, the hands 4 do not start operating and the time correction operation becomes invalid; however, because the brake is released when the crown is pulled out, by pushing in the crown after performing a time correction operation for the hands 4, the hands 4 starts operating for sure, and the time correction operation becomes valid, serving to improve operability.

(5) When the braking amount is above the first braking preset value, brake control can be performed based on the output QD of the up/down counter 60. Thus, an optimal brake control can be performed in accordance with the rotation rate of the generator 2 irrespective of the reference period. Accordingly, an accurate and sufficient braking amount can be applied compared with a case where a brake-on control and a brake-off control are always performed within a single cycle, serving to enhance response of speed governing. Thus, variation in the rotation rate of the rotor of the generator 2 can be reduced, so that the generator 2 rotates stably at a substantially constant rate.

(6) A strong brake control is performed using a chopper signal having a large duty ratio, so that the braking torque can be increased while preventing a drop in the charge voltage, and brake control can be performed efficiently while maintaining stability of the system.

Accordingly, the duration of the electronically controlled mechanical timepiece can be extended.

(7) A weak brake control is performed using a chopper signal having a small duty ratio, so that the charge voltage during a weak braking can be further improved.

(8) When the hands are operating correctly, the switching between strong brake control and weak brake control is performed based only on whether the counter value is smaller than or equal to the first counter preset value of "7" or the counter value is larger than or equal to "8". Thus, the rotation controlling unit 50 can be implemented in a simple construction, serving to reduce component cost and manufacturing cost, thus serving to provide an inexpensive electronically controlled mechanical timepiece.

(9) The timing at which up-count signals are input changes in accordance with the rotation rate of the generator 2, thus an automatic control is performed while the counter value is "8", i.e., while the brake is on. Accordingly, quick-response and stable control can be performed, particularly in a locked state where up-count signals and down-count signals are input alternately.

(10) The up/down counter 60 is used as a brake controlling unit, so that the comparison (difference) between the counts of up-count signals and down-count signals can be automatically calculated simultaneously while counting the up-count signals and the down-count signals, serving to simplify the construction and readily allowing calculation of the difference between the counts.

(11) The four-bit up/down counter 60 allows counting up to sixteen values. Thus, for example, when up-count signals are input continuously, the input value can be accumulatively counted, and the accumulated error can be corrected within the preset range, i.e., until the counter value becomes 15 or 0 by continuous input of up-count signals or down-count signals. Thus, even if the rotation rate of the generator 2 deviates significantly from the reference rate, although it takes time to reach a locked state, the accumulated error can be accurately corrected so as to return the rotation rate of the generator 2 to the reference rate, thereby maintaining correct operation of hands in the long run.

(12) The initialization circuit 90 is provided so that brake control is not performed until the power supply circuit is charged to a predetermined voltage at power-up of the generator 2, so that a brake is not applied on the generator 2. Thus, the power supply circuit 6 is charged with priority, so that the power supply circuit 6 quickly and stably drive the rotation controlling unit 50 and the stability of the subsequent rotation control can be improved.

(13) The generator halting unit 56 is implemented by various logic circuits, serving to reduce the size of the circuit and to save power.

Next, a second embodiment of the present invention will be described. In the first embodiment described above, the number of brake-off conditions is counted to detect that the braking amount has become smaller than or equal to the first braking preset value. In this embodiment, the number of short-brake applications in which the brake-on time is shorter than or equal to a preset time is counted to detect that the braking amount has become smaller than or equal to the first braking preset value.

More specifically, the electric generator halting unit 56 includes a counter value detecting circuit 210A, a divider circuit 220, and a flip-flop 230, as shown in FIG. 9.

The divider circuit 220 and the flip-flop 230 are identical to those in the first embodiment, and description thereof will be omitted.

The counter value detecting circuit 210A includes a NOT gate 215 to which the output QD of the up/down counter 60 is input, an AND gate 216 to which a signal inverted by the NOT gate 215 and a signal SP2 are input, and AND gates 217 and 218 and a flip-flop 219 for outputting the signal SP2.

To the AND gate 217, the output Q10, the output Q11, and the inverted signal of the output Q12 of the divider circuit 54 are input. The output of the AND gate 217 serves as data input to the flip-flop 219, and the output Q5 of the divider circuit 54 is input to the, clock input of the flip-flop 219. The inverted output XQ (indicated in the figure by a horizontal bar over Q) of the flip-flop 219 and the output of the AND gate 217 are input to the AND gate 218, and the AND gate 218 outputs a signal SP2. As shown in FIG. 10, the signal SP2 outputs a rising pulse for a DOWN signal based on the reference signal fs (8 Hz) before a predetermined time BP.

The output QD rises from "L" to "H" when an UP signal synchronized with the signal FG 2 is input to the up/down counter 60 to turn the counter value from "7" to "8", and falls from "H" to "L" when a DOWN signal is input to turn the counter value from "8" to "7".

Thus, the brake-on control (strong brake control) time is shorter than the preset time BP if the width (length, or time) of an H-level signal at the output QD is shorter than the preset time BP, and the braking amount is smaller than or equal to the preset value.

When the inverted signal of the output QD and the signal SP2 are input to the AND gate 216, an H-level signal is output if the width (length, or time) of an H-level signal at the output QD is shorter than the preset time BP whereas an L-level signal is output if it is longer.

Thus, the divider circuit 220 counts the number of short-brake applications in which a control is performed in one minute with a braking amount smaller than or equal to the preset value (time BP), and if the count is larger than or equal to the preset number of times of short-brake applications (64), the output F6 goes to H level and the generator halting signal CH3 goes to H-level.

Subsequently, similarly to the first embodiment described earlier, a strong brake control is performed until the crown is pulled out to the second tier, so that the generator 2 is halted.

Also in this embodiment, the same operation and advantages as in the first embodiment described earlier are achieved.

In addition, as opposed to the first embodiment in which the generator 2 is halted based on the number of times (ratio) of brake-off controls (weak brake controls) in a predetermined time (one minute), in this embodiment, the generator 2 is halted based on the number (ratio) of short brake-on controls (strong brake controls) not longer than the time BP in the predetermined time (one minute). Accordingly, the brake-on preset time BP as well as the number of short-brake applications (64 in the embodiment described above) can be set as appropriate; thus, compared with the first embodiment in which only the number of brake-off conditions can be set, more detailed control is allowed so that optimal conditions can be set in accordance with each apparatus.

The present invention is not limited to the embodiments, and alternatives, modifications, etc. which achieve the object of the present invention are included in the present invention.

For example, the duty ratio of chopper signal in the chopper signal generating unit 80 is not limited to 1/16 or 15/16 as in the embodiments, and may be other values, for example, 14/16. Furthermore, the duty ratio of chopper signals may be 28/32, 31/32, etc., so that the duty ratio can be varied in 32 steps instead of 16 steps. In that case, the duty ratio of a chopper signal used for strong brake control is preferably in a range on the order of 0.75 to 0.97, and the charge voltage can be further enhanced in a range on the order of 0.75 to 0.89 whereas the braking force can be further enhanced in a higher range of 0.90 to 0.97.

In the embodiments, the duty ratio of chopper signals used for weak brake control may be as low as, for example, in a range on the order of 1/16 to 1/32. In effect, the duty ratio and frequency of chopper signals may be set as appropriate in implementation. For example, if the frequency is set in a high range from 500 to 1100 Hz, the charge voltage can be further enhanced. On the other hand, if the frequency is set in a low range of 25 to 50 Hz, the braking force can be further enhanced. Thus, by changing the frequency as well as duty ratio of chopper signals, charge voltage and braking force can be further enhanced.

Furthermore, although the first counter preset value of the up/down counter 60 is "7" and the second counter preset value is "6" in the first embodiment, for example, the second counter preset value may be set to "5", and the preset values may be set as appropriate. However, when the generator is controlled normally, "7" (first counter preset value) and "8" are alternately input, and thus the second counter preset value should be set to a value at least different from the first counter preset value (a value smaller than the first counter preset value if the counter value is decreased in accordance with the rotation rate of the generator being diminished).

Although the four-bit up/down counter 60 is used as a brake controlling unit in the embodiments, an up/down counter having three or fewer bits or an up/down counter having five or more bits may be used. If an up/down counter having a large number of bits is used, the countable number of values increases, and thus the range of accumulated error which can be stored is increased, providing advantage particularly for a control in an unlocked state, for example, immediately after activation of the generator 2. On the other hands, if a counter having a small number of bits is used, although the range of accumulated error which can be stored is decreased, up-count and down-count is repeated particularly in a locked state, even a one-bit counter may be used, providing an advantage of reduced cost.

The brake controlling unit is not limited to an up/down counter, and may be implemented by first and second counting means respectively provided for the reference signal fs and the rotation detection signal FG1, and a comparator circuit for comparing the counts by each of the counting means. However, implementation using an up/down counter has an advantage that the circuit configuration is simplified.

Furthermore, the brake controlling unit may detect, for example, a voltage generated by the generator 2, the rotation rate thereof, etc., controlling a brake in accordance with the detected value, and the specific construction may be determined as appropriate in implementation.

Furthermore, the method of detecting whether the braking amount is smaller than or equal to the first braking preset value is not limited to the one using the up/down counter 60 as in the embodiments, and the detection may be based on a torque applied to the generator 2, a voltage generated by the generator 2, the rotation rate, etc. In effect, a method which is capable of detecting the amount of a brake currently being applied to the generator 2 is selected as appropriate.

Furthermore, although the braking force of the rotor is controlled using chopper signals in the embodiments, the brake may be controlled without using the chopper signals. For example, the output of the OR gate 86, to which the generator halting signal Ch3 from the generator halting unit 56 and the output QD are input, may be inverted via an inverter to form a braking signal CH5, so that the brake is continuously applied if the output QD or the generator halting signal CH3 is a H-level signal while releasing the brake if the output QD and the generator halting signal CH3 are both L-level signals.

Furthermore, although a strong brake control and a weak brake control are performed using two types of chopper signal in the embodiments, the speed may be governed by a strong brake control using a chopper signal and a brake-off control in which the brake is completely released.

Furthermore, the specific configurations of the rectifier circuit 5, the braking circuit 20, the control circuit 53, the chopper signal generating unit 80, etc. are not limited to those in the embodiments as long as a brake control can be performed, for example, by a chopper control, on the generator 2 of the electronically controlled mechanical timepiece. In particular, the rectifier circuit 5 is not limited to the configuration using chopper boosting in the embodiments, and may be implemented, for example, by incorporating a boosting circuit in which a plurality of capacitors is provided and a voltage is boosted by switching connections therebetween, and may be arranged as appropriate in accordance with, for example, the type of an electronically controlled mechanical timepiece in which the generator 2 and the rectifier circuit are to be incorporated.

The switches for forming a closed loop between both ends of the generator 2 are not limited to the switches 21 and 22 in the embodiments. For example, resistors may be connected to the transistors in the path of a closed loop which is formed between both ends of the generator 2 when the transistors are turned on by chopper signals. In effect, any switches can be used as long as they form a closed loop between both ends of the generator 2.

The present invention is not limited to application to an electronically controlled mechanical timepiece as in the embodiments, and may be applied to various electronic apparatuses such as a bracket clock, various timepieces such as clocks, portable watches, portable blood pressure gauges, portable phones, pagers, ems pedometers, electronic calculators, portable personal computers, electronic notebooks, electronic radios, music boxes, metronomes, electric razors, etc.

For example, when the present invention is applied to a music box, the generator can be rotated accurately when in operation and the generator can be halted for sure when the torque is diminished. Accordingly, the generator is prevented from being halted due to a disturbance, etc., allowing operation for an extended time, so that an accurate performance is achieved for an extended time and the performance is stopped when an accurate performance is no longer possible, allowing the user to recognize an abnormality for sure.

Furthermore, when the present invention is applied to a metronome, a metronome sound generating wheel is attached to the teeth of the gear train, so that the vibrating reed of the metronome is played by the rotation of the wheel to generate a periodic metronome sound. The metronome is required to generate sound in accordance with various tempos, which is in this case achieved by changing the divider stage of the crystal resonator to vary the period of the reference signal from the oscillation signal.

The first braking preset value, more specifically, the preset number of time of brake-off conditions or the preset number of times of short-brake applications, may be set as appropriate, for example, in accordance with the type of an electronic apparatus to which the present invention is applied. The first braking preset value can be determined by actually obtaining results of controlling the generator and change in the braking amount at that time, for example, through an experiment.

The brake releasing means is not limited to the one in the embodiments. For example, a dedicated button, etc. for releasing the brake may be provided as an external operation member, so that the brake will be released when the button, etc., is operated.

Furthermore, the brake may be automatically released after an elapse of time from when a brake control for halting the generator 2 is performed. By automatically releasing the brake, a separate releasing operation is not required, serving to further improve operability.

Furthermore, the mechanical energy source is not limited to the mainspring, and may be rubber, a spring, a plumb bob, etc., and may be set as appropriate in accordance with applications of the present invention.

Furthermore, the energy transmitting device which transmits a mechanical energy from a mechanical energy source such as the mainspring to the generator is not limited to the gear train (toothed wheels) as in the embodiments, and friction gears, belts and pulleys, chains and sprocket wheels, racks and pinions, cams, etc. may be used, and may be chosen as appropriate in accordance with, for example, the type of an electronic apparatus to which the present invention is applied.

Furthermore, the control circuit 53 is not limited to implementation in hardware such as the up/down counter 60, flip-flops, and various logic elements as in the embodiments described above, and the functions of the brake controlling unit 55, the generator halting unit 56, and the brake releasing unit 57 may be implemented by providing a computer including a CPU (central processing unit), a memory (storage device), etc. in an electronic apparatus and installing a predetermined program on the computer.

For example, the functions of the brake controlling unit 55, the generator halting unit 56, and the brake releasing unit 57 may be implemented by providing a CPU, a memory, etc. in an electronic apparatus such as a timepiece so as to achieve functionality of a computer, installing a predetermined control program on the memory via communications means such as the Internet or a storage medium such as a CD-ROM or DVD-ROM, a memory card, electromagnetic communication waves, hard drive or other electro-optical data storage device, floppy disk, etc., and operating the CPU, etc. according to the program.

The predetermined program may be installed on an electronic apparatus such as a timepiece by directly communicating with a memory card, a CD-ROM or DVD-ROM, electromagnetic communication waves, hard drive or other electro-optical data storage device, floppy disk, etc. in the electronic apparatus or by externally connecting a device for reading the storage medium to the electronic apparatus. Furthermore, the program may be supplied and installed by communications via a LAN cable, a phone line, etc. connected to the electronic apparatus, or the program may be supplied and installed by wireless communications.

By installing a control program according to the present invention on an electronic apparatus via a storage medium or communications means such as the Internet, a brake can be applied to halt the generator when the rotation of the generator becomes slow and the braking amount becomes smaller than or equal to the first braking preset value. Accordingly, the same advantages as in the embodiments described above are obtained, such as a constant accurate rotation control when the generator is in operation. In addition, the first braking-preset value can be readily set in accordance with characteristics of various electronic apparatuses, and an even more accurate rotation control can be performed for each of the electronic apparatuses.

The program supplied via various storage media, communications means, etc. is a control program for controlling an electronic apparatus comprising a mechanical energy source; a generator which is driven by the mechanical energy source to generate an induced voltage and supply an electric energy; and a rotation controlling unit which is driven by the electric energy to control the rotation rate of the generator; the program including programs for letting the rotation controlling unit function as brake controlling means for performing a brake control for the generator by comparing a rotation detection signal in accordance with a rotation rate of the generator with a reference signal generated in accordance with a signal from a time reference source, and generator halting means which applies a brake to halt the generator when the braking amount applied by the brake control means on the generator in a preset time is smaller than or equal to a first braking preset value, and the program may include other control programs, etc.

[Advantages]

As described above, according to an electronic apparatus, an electronically controlled mechanical timepiece, methods of controlling them, a program for controlling an electronic apparatus, and a storage medium of the present invention, a generator is halted for sure when the rotation of the generator becomes slow while the generator is prevented from being halted due to a temporary effect such as a disturbance so that the duration will be extended accordingly.

While the invention has been described in conjunction with several specific embodiments, it is evident to those skilled in the art that many further alternatives, modifications and variations will be apparent in light of the foregoing description. Thus, the invention described herein is intended to embrace all such alternatives, modifications, applications and variations as may fall within the spirit and scope of the appended claims.

What is claimed is:

1. An electronic apparatus comprising:

a mechanical energy source;

a generator driven by said mechanical energy source to generate an induced voltage and supply electrical energy; and a rotation controlling unit driven by said electrical energy to control the rotation rate of said generator, wherein said rotation controlling unit includes:

a brake controller to apply brake control to said generator as determined by the comparison of a rotation detection signal indicative of the rotation rate of said generator with a reference signal generated in accordance with a signal from a time reference source; and a generator halting device to halt said generator irrespective of said brake controller if the amount of braking applied to said generator by said brake controller within a predetermined time period is smaller than, or equal to, a first predetermined braking value.

2. An electronic apparatus according to claim 1, wherein said generator halting device includes a braking-amount detector to monitor for brake-off conditions in which no brake is applied to said generator, and to detect the amount of braking applied to said generator by counting the occurrences of said brake-off conditions, and if the number of amount of brake-off conditions within said predetermined time period, as detected by said braking-amount detector, is larger than or equal to a preset number of brake-off conditions, then said braking-amount detector determines that the braking amount within said predetermined time period is smaller than or equal to said first predetermined braking value, whereby said generator is placed in an active braking condition to halt said generator.

3. An electronic apparatus according to claim 2, wherein:

said brake controller includes an up/down counter having an up-count input coupled to one of said rotation detection signal and reference signal and having a down-count input coupled to the other of said rotation detection signal and reference signal;

said brake controller requests a brake-on operational state, in which the brake is applied to said generator, by issuing a brake-on signal and requests a brake-off operational state, in which no brake is applied to said generator, by issuing a brake-off signal; wherein said brake controller issues said brake-on signal when the value of said up/down counter becomes larger than a first counter preset value, and issues said brake-off signal when the value of said up/down counter becomes smaller than, or equal to, said first counter preset value; and said braking-amount detector counts, as the number of said brake-off occurrences, the number of times the counter value of said up/down counter is smaller than, or equal to, a second counter preset value smaller than said first counter preset value.

4. An electronic apparatus according to claim 1, wherein said brake controller applies the brakes on said generator in the form of a series of brake-pulses of various durations;

said generator halting device includes a braking-amount detector that detects the braking amount by counting the number of brake-pulses within said predetermined time period whose application time is shorter than a brake-on preset time, and if the number of counted brake-pulses, as detected by said braking-amount detector, is larger than or equal to a preset number of pulses, then said generator halting device determines that the braking amount within said predetermined time period is smaller than or equal to said first predetermined braking value, whereby said generator is placed in an active braking condition to halt said generator.

5. An electronic apparatus according to one of claim 2, wherein said brake controller further applies a first brake on said generator during a brake-on condition of said generator and applies a second brake, weaker than said first brake, on said generator during a brake-off condition of said generator; and said generator halting device halts said generator only if said generator is in said brake-on condition.

6. An electronic apparatus according to one of claim 1, wherein:

said generator halting device halts said generator by actuating the brake that is under brake control of said braking controller;

said rotation controlling unit further includes a brake releasing mechanism to release the brake that halts said generator, wherein only said brake release may release the brake that halts said generator once it is actuated by said generator hating device.

7. An electronic apparatus according to claim 6, wherein said brake releasing mechanism releases the brake that halts said generator in response to a user-operated, external, operation member.

8. An electronic apparatus according to claim 6, wherein said brake releasing mechanism releases the brake that halts said generator after the elapse of a preset time from whence the brake is applied by said generator halting device.

9. An electronically controlled mechanical timepiece comprising:

a mechanical energy source;

a generator driven by said mechanical energy source to generate an induced voltage and supply electrical energy;

a rotation controlling unit driven by said electrical energy to control the rotation rate of said generator; and a time indication unit that operates in association with the rotation of said generator;

wherein said rotation controlling unit includes:

a brake controller that applies brake control to said generator as determined by the comparison of a rotation detection signal indicative of a rotation rate of said generator with a reference signal generated in accordance with a signal from a time reference source; and a generator halting device to halt said generator and to halt said time indication unit if the amount of braking applied to said generator by said brake controller within a predetermined time period is smaller than or equal to a first predetermined braking value.

10. An electronically controlled mechanical timepiece according to claim 9, wherein:

said generator halting device halts said generator by actuating the brake that is under brake control of said braking controller;

said rotation controller further includes a brake releasing mechanism for releasing the brake that halts said generator, wherein only said brake releasing mechanism may release the brake that halts said generator once it is actuated by said generator hating device.

11. A method of controlling an electronic apparatus having a mechanical energy source, a generator driven by said mechanical energy source to generate an induced voltage and supply electrical energy, and a rotation controlling unit driven by the electrical energy to control the rotation rate of said generator, said method comprising;

comparing a rotation detection signal indicative of a rotation rate of said generator with a reference signal generated in accordance with a signal from a time reference source;

applying brake control to said generator in accordance with the comparison result;

halting said generator if the amount of braking applied to said generator by said brake control within a predetermined time period is smaller than or equal to a first predetermined braking value.

12. A method of controlling an electronically controlled mechanical timepiece having a mechanical energy source, a generator driven by said mechanical energy source to generate an induced voltage and supply an electrical energy, a rotation controlling unit driven by said electrical energy to control the rotation rate of said generator, and a time indication unit that operates in association with the rotation of said generator, said method comprising:

comparing a rotation detection signal indicative of a rotation rate of said generator with a reference signal generated in accordance with a signal from a time reference source;

applying brake control to said generator in accordance with the comparison result;

halting said generator and said time indication unit if the amount of braking applied to said generator by said brake control within a predetermined time period is smaller than or equal to a first predetermined braking value.

13. A storage medium storing a computer program for implementing a method for controlling an electronic apparatus having a mechanical energy source, a generator driven by said mechanical energy source to generate an induced voltage and supply electrical energy, and a rotation controlling unit driven by said electrical energy to control the rotation rate of said generator, said method including;

comparing a rotation detection signal indicative of the rotation rate of said generator with a reference signal generated in accordance with a signal from a time reference source;

applying brake control on said generator in accordance with the comparison result; and halting said generator if the amount of braking applied to said generator by said brake control within a predetermined time period is smaller than or equal to a first predetermined braking value.

* * * * *